US007336229B1

(12) United States Patent
Tseng et al.

(10) Patent No.: US 7,336,229 B1
(45) Date of Patent: Feb. 26, 2008

(54) ANTENNA CAPABLE OF ADJUSTING IMPEDANCE MATCHING

(75) Inventors: Kuan-Hsueh Tseng, Taipei Hsien (TW); Feng-Chi Eddie Tsai, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 0 days.

(21) Appl. No.: 11/670,422

(22) Filed: Feb. 2, 2007

(30) Foreign Application Priority Data

Dec. 18, 2006 (TW) ..... 95222262 U

(51) Int. Cl.
*H01Q 1/24* (2006.01)

(52) U.S. Cl. ..... 343/702; 343/700 MS

(58) Field of Classification Search ..... 343/700 MS, 343/702
See application file for complete search history.

(56) References Cited

U.S. PATENT DOCUMENTS 6,844,853 B2 * 1/2005 Tai et al. ..... 343/700 MS
7,292,194 B2 * 11/2007 Tai et al. ..... 343/702
2007/0030198 A1 * 2/2007 Wei ..... 343/700 MS
2007/0188388 A1 * 8/2007 Feng et al. ..... 343/700 MS

* cited by examiner

*Primary Examiner*—Trinh Dinh
*Assistant Examiner*—Dieu Hien T Duong
(74) *Attorney, Agent, or Firm*—Winston Hsu

(57) ABSTRACT

An antenna includes a substrate, a radiation element, a feeding element, a connection element, and a matching circuit. The substrate includes a first side and a second side. The first side includes a short point and a grounding point. The radiation element includes a first radiator, a second radiator, and a first metal arm. The first radiator and the second radiator are parallel to the first side. The first metal arm is coupled to a joint of the first radiator and the second radiator. The feeding element is coupled between the first metal arm and the grounding point. The connection element is coupled between the first metal arm and the short point. The matching circuit includes a second metal arm and a matching element. The second metal arm extends from the first metal arm. The matching element is coupled to the second metal arm.

19 Claims, 10 Drawing Sheets

ANTENNA CAPABLE OF ADJUSTING IMPEDANCE MATCHING

BACKGROUND OF THE INVENTION

1. Field of the Invention

The present invention relates to an antenna capable of adjusting impedance matching, and more particularly, to an antenna utilizing a matching circuit for adjusting the impedance matching.

2. Description of the Prior Art

As wireless telecommunication develops with the trend of micro-sized mobile communication products, the location and the space arranged for antennas are limited. Therefore, some built-in micro antennas have been developed. Currently, some micro antennas such as a chip antenna, a planar antenna and so on are commonly used. All these antennas have the feature of small volume. Additionally, planar antennas are also designed in many types such as microstrip antennas, printed antennas and planar inverted F antennas. These antennas are widespread applied to GSM, DCS, UMTS, WLAN, Bluetooth, etc.

Please refer to FIG. 1, which is a diagram of a dual-frequency antenna 10 in the prior art. The dual-frequency antenna 10 includes a substrate 12, a radiation element 14, a connection element 16, and a feed element 18. The substrate 12 approximately is a rectangle, and has a first side 122 and a second side 124. The first side 122 includes a short point 126 and a grounding point 128. The radiation element 14 is installed on the first side 122. The radiation element 14 includes a first radiator 141, a second radiator 142, and a first metal arm 143. The first radiator 141 approximately parallels the first side 122. The second radiator 142 approximately parallels the first side 122 and is extended in a direction opposite to the first radiator 141. A rear end of the first radiator 141 and a rear end of the second radiator 142 each comprise a bending 146 and 148 used for individually increasing radiation efficiency of the first radiator 141 and the second radiator 142. The first metal arm 143 is approximately perpendicular to the first side 122 and has a first end 144 coupled to a joint of the first radiator 141 and the second radiator 142, and a second end 145. The feeding element 18 is coupled between the second end 145 of the first metal arm 143 and the grounding point 128. The connection element 16 is approximately an L shape and has a first end 163 coupled to the second end 145 of the first metal arm 143, and a second end 165 coupled to the short point 126 of the substrate 12.

As shown in FIG. 1, due to a length of the first radiator 141 being greater than a length of the second radiator 142, signals of a first resonance mode (low frequency) can be resonated by the first radiator 141 and signals of a second resonance mode (high frequency) can be resonated by the second radiator 142. A sum of the length of the first radiator 141 and a length of the first metal arm 143 is approximately one-fourth of a wavelength of the first resonance mode generated by the dual-frequency antenna 10($\lambda/4$). A sum of the length of the second radiator 142 and the length of the first metal arm 143 is approximately one-fourth of a wavelength of the second resonance mode generated by the dual-frequency antenna 10. The substrate 12 comprises dielectric material or magnetic material and is coupled to a system ground terminal (GND). The radiation element 14 and the connection element 16 are each substantially composed of a single metal sheet.

Please refer to FIG. 2 and FIG. 1. FIG. 2 is a diagram illustrating the VSWR (voltage standing wave ratio) of the dual-frequency antenna 10 in FIG. 1. The horizontal axis represents frequency (GHz) that distributes from 0.7 GHz to 2.5 GHz, and the vertical axis represents VSWR defined by an equation of VSWR=Vmax/Vmin. As shown in FIG. 2, the frequencies and the VSWR of eight points are marked, for example, the frequency of the point 1 is about 0.826 GHz and its VSWR is about 3.503; the frequency of the point 8 is about 2.17 GHz and its VSWR is about 1.943. Thus it can be seen that the bandwidth of the first resonance mode generated by the dual-frequency 10 falls in the neighborhood of 900 MHz, and the bandwidth of the second resonance mode falls in the neighborhood of 1900 MHz.

Nowadays, notebook computers have become one of the common electronic consumer products in human life. The ability to enter a network through wireless local area networks (WLAN) has become a standard equipment of the notebook computers. It is impossible to enter the network wirelessly if lying in an environment without the wireless local area networks. Hence, an idea of making the notebook computers enter the network wirelessly and speedily through mobile base stations grows in abundance and somewhat suddenly. Thus antennas should not only conform to operational bandwidths of wireless local area networks but also conform to operational bandwidths of wireless wide area networks (WWAN). How to reduce sizes of the antennas, improve antenna efficiency, and improve impedance matching becomes an import topic of the field.

SUMMARY OF THE INVENTION

The claimed invention provides an antenna capable of adjusting impedance matching. The antenna includes a substrate, a radiation element, a feeding element, a connection element, and a matching circuit. The substrate includes a first side and a second side, and the first side includes a short point and a grounding point. The radiation element is installed on the first side and includes a first radiator, a second radiator, and a first metal arm. The first radiator approximately parallels the first side. The second radiator approximately parallels the first side and is extended in a direction opposite to the first radiator. The first metal arm is approximately perpendicular to the first side and has a first end coupled to a joint of the first radiator and the second radiator, and a second end. The feeding element is coupled between the second end of the first metal arm and ground. The connection element has a first end coupled to the second end of the first metal arm, and a second end coupled to the short point. The matching circuit is installed between the radiation element and the first side of the substrate, and includes a second metal arm and a matching element. The second metal arm is extended from the first metal arm, and the matching element is coupled to the second metal arm for providing impedance. The matching element comprises passive elements, such as an inductor, a capacitor, or a resistor, etc.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
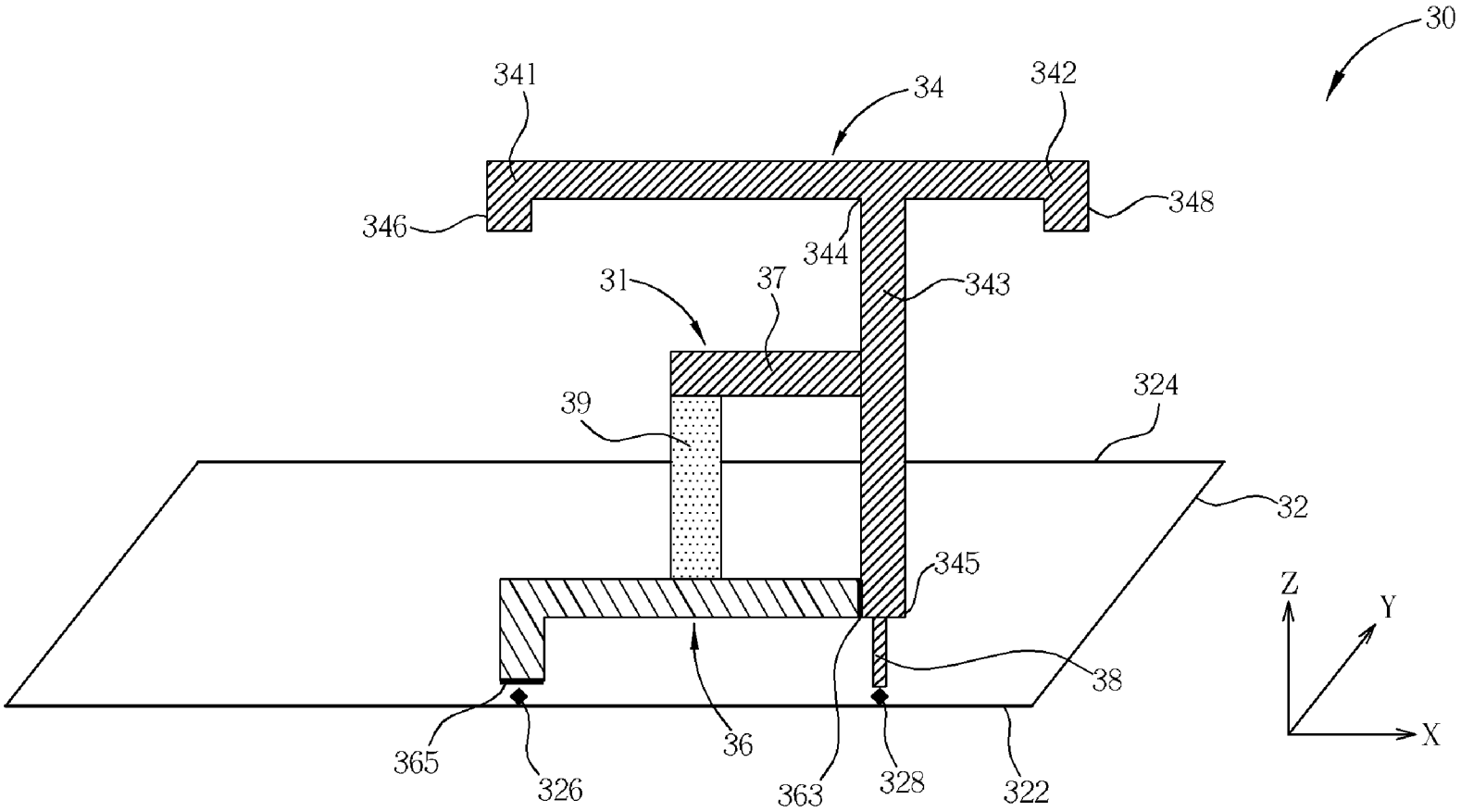
FIG. 3 is a diagram of an antenna capable of adjusting impedance matching according to an embodiment of the present invention.

Please refer to FIG. 3. FIG. 3 is a diagram of an antenna 30 capable of adjusting impedance matching according to an embodiment of the present invention. The antenna 30 includes a substrate 32, a radiation element 34, a feeding element 38, a connection element 36, and a matching circuit 31. The substrate 32 is approximately a rectangle and includes a first side 322 and a second side 324, whereof the first side 322 includes a short point 326 and a grounding point 328. The radiation element 34 is installed on the first side 322 and includes a first radiator 341, a second radiator 342, and a first metal arm 343. The first radiator 341 approximately parallels the first side 322. The second radiator 342 approximately parallels the first side 322 and is extended in a direction opposite to the first radiator 341. A rear end of the first radiator 341 and a rear end of the second radiator 342 each comprise a bending 346 and 348 used for individually increasing radiation efficiency of the first radiator 341 and the second radiator 342. The first metal arm 343 is approximately perpendicular to the first side 322 and has a first end 344 coupled to a joint of the first radiator 341 and the second radiator 342, and a second end 345. The feeding element 38 is coupled between the second end 345 of the first metal arm 343 and the grounding point 328.

The connection element 36 is approximately an L shape and has a first end 363 coupled to the second end 345 of the first metal arm 343, and a second end 365 coupled to the short point 326 of the substrate 32. A length of the connection element is a first length L1. The matching circuit 31 is installed between the radiation element 34 and the first side 322 of the substrate 32. The matching circuit 31 includes a second metal arm 37 and a matching element 39. The second metal arm 37 is extended from the first metal arm 343 and its length is a second length L2. The matching element 39 is coupled to the second metal arm 37 for providing impedance. The matching element 39 is coupled between the second metal arm 37 and the connection element 36. In this embodiment, the first length L1 (FIG. 3) is about $\lambda/8\sim2\lambda/5$ (when the frequency is 1900 MHz), and the ratio of the second length L2 to the first length L1 is L2/L1=0.125~0.75. When the matching element 39 is implemented by a capacitor, its capacitance value is 0.5 pF~5 pF but is not limited to a fixed value only. Besides, the matching element 39 is not limited to capacitors only and can be adjusted depends on customer's demands. When an inductor implements the matching element 39, its inductance value is 1 nH~10 nH but is not limited to a fixed value only. The relationship between the second length L2 and the first length L1 is expressed by L1/3<L2<L1/2.

Please keep referring to FIG. 3. Due to a length of the first radiator 341 being greater than a length of the second radiator 342, signals of a first resonance mode (low frequency) can be resonated by the first radiator 341 and signals of a second resonance mode (high frequency) can be resonated by the second radiator 342. A sum of the length of the first radiator 341 and a length of the first metal arm 343 is approximately one-fourth of a wavelength of the first resonance mode generated by the antenna 30 ($\lambda/4$). A sum of the length of the second radiator 342 and the length of the first metal arm 343 is approximately one-fourth of a wavelength of the second resonance mode generated by the antenna 30. The substrate 32 comprises dielectric material or magnetic material and is coupled to a system ground terminal (GND). The radiation element 34 and the connection element 36 are each substantially composed of a single metal sheet. The matching element 39 comprises passive elements, such as an inductor, a capacitor, or a resistor, etc. The antenna 30 is installed in a wireless communication device, such as a notebook computer, a mobile phone or a personal digital assistant (PDA).

Figure 1:
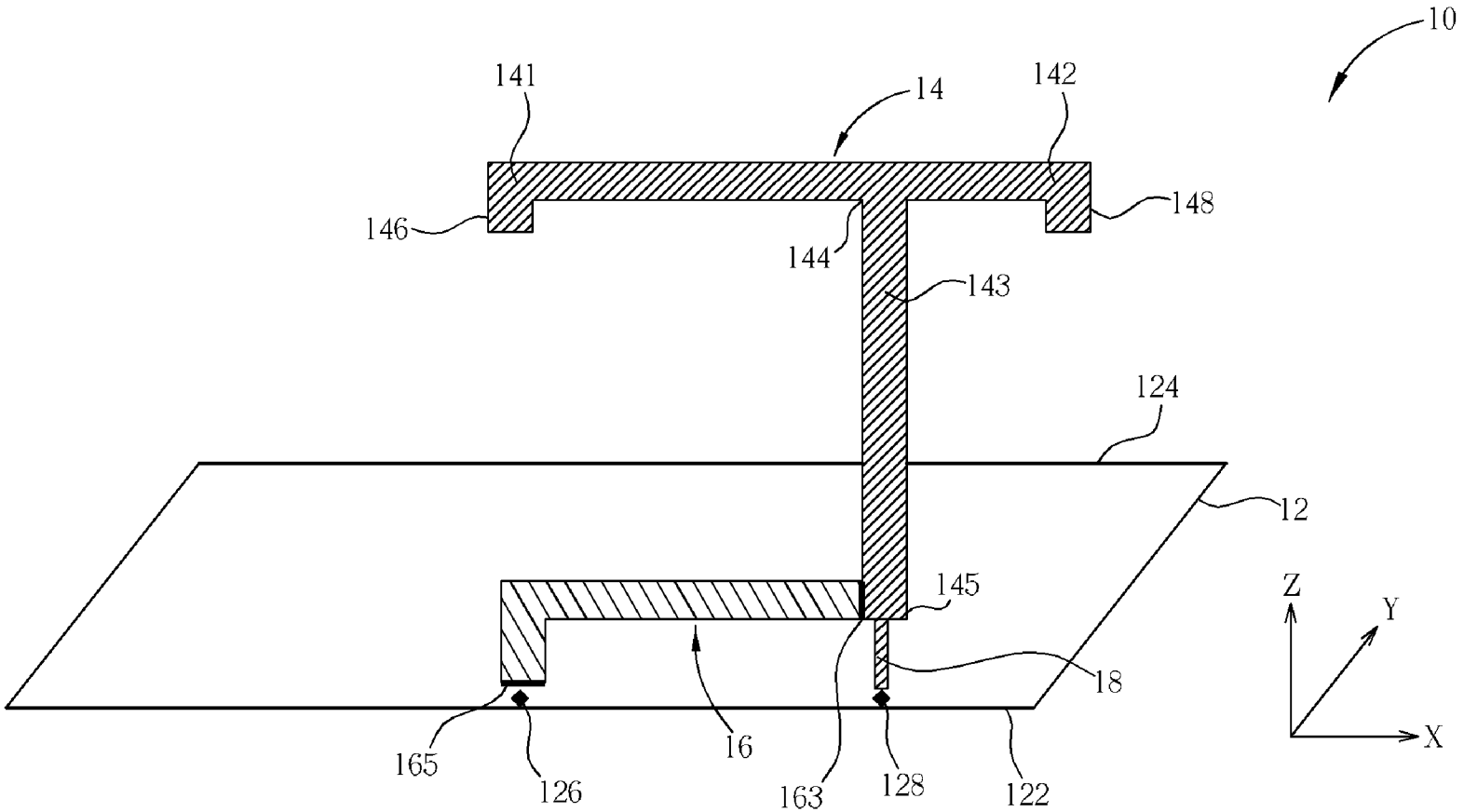
Fig. 1 Prior Art
FIG. 1 is a diagram of a dual-frequency antenna in the prior art.
Figure 2:
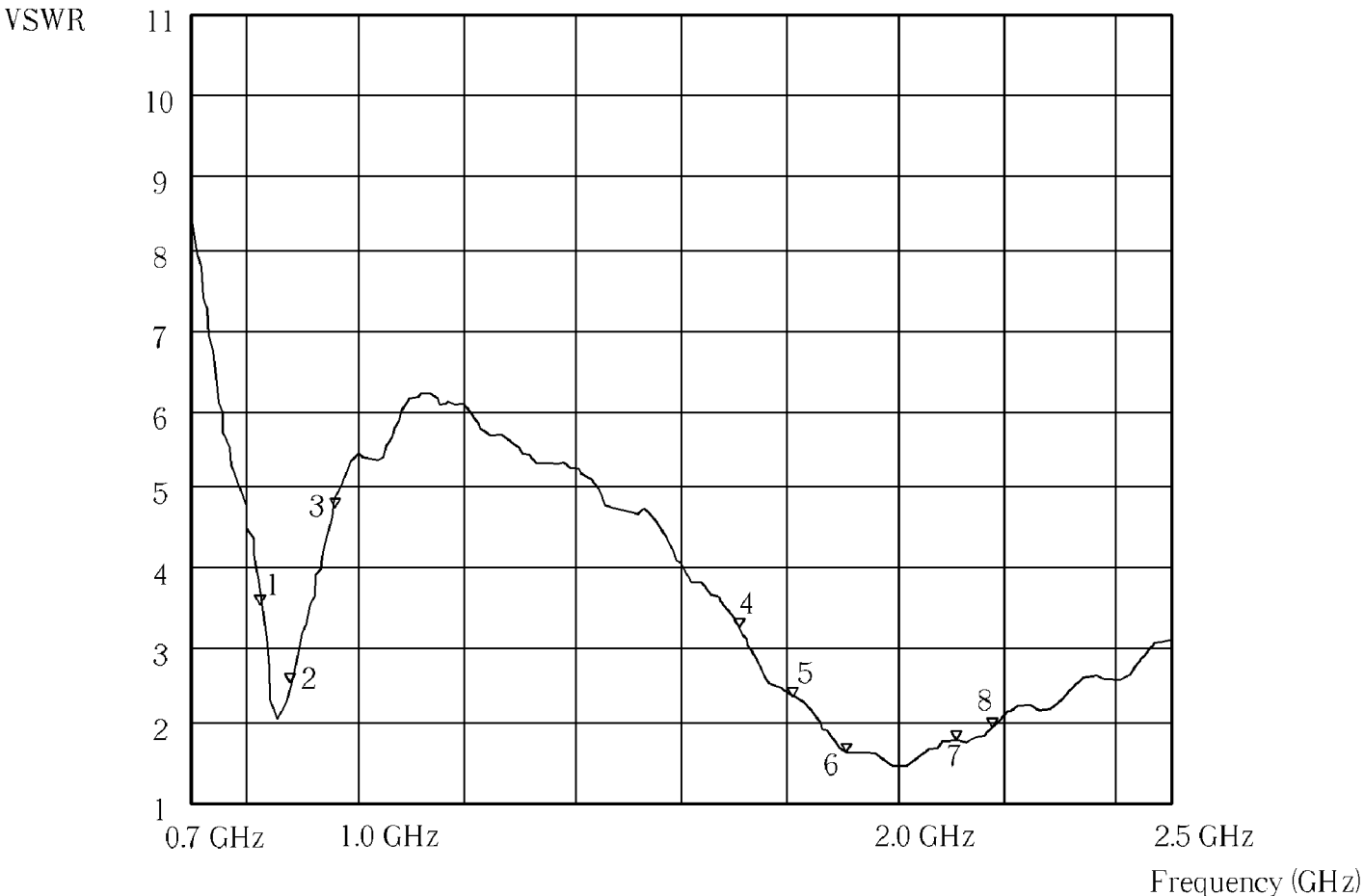
Fig. 2 Prior Art
FIG. 2 is a diagram illustrating the VSWR of the dual-frequency antenna in FIG. 1.
Figure 4:
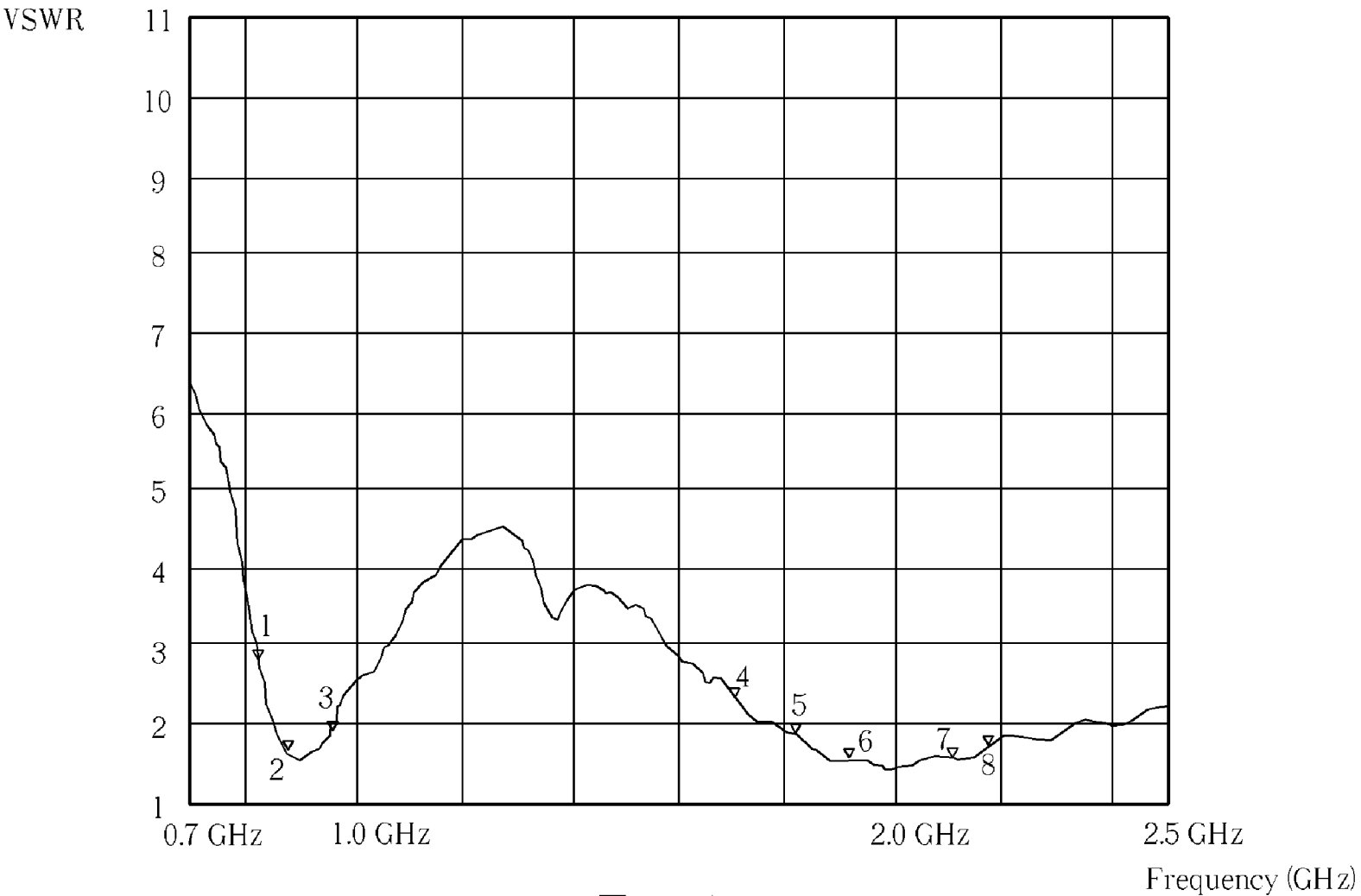
FIG. 4 is a diagram illustrating the VSWR of the antenna in FIG. 3.

Please refer to FIG. 4, which is a diagram illustrating the VSWR of the antenna in FIG. 3. The horizontal axis represents frequency (GHz) that distributes from 0.7 GHz to 2.5 GHz, and the vertical axis represents VSWR defined by an equation of VSWR=Vmax/Vmin. The frequencies and the VSWR of eight points are marked, whereof the eight points marked in FIG. 4 have the same frequencies as the eight points marked in FIG. 2. For example, the frequency of the point 1 is about 0.826 GHz and its VSWR is about 2.84; the frequency of the point 8 is about 2.17 GHz and its VSWR is about 1.03. When comparing FIG. 4 with FIG. 2, it can be seen that both the VSWR and the impedance matching of the antenna 30 are better than the dual-frequency antenna 10 in FIG. 1.

Figure 5:
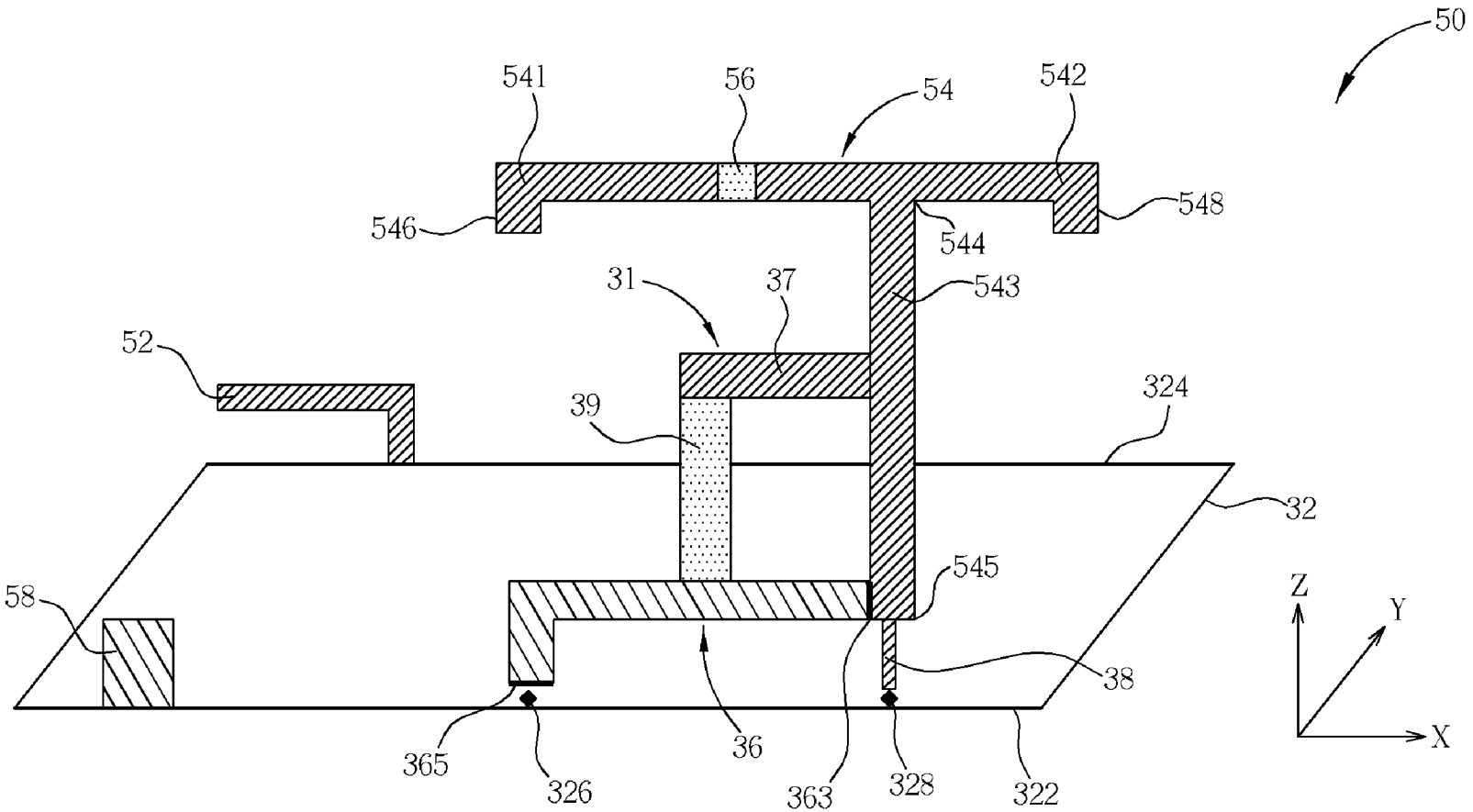
FIG. 5 is a diagram of an antenna capable of adjusting impedance matching according to another embodiment of the present invention.

Please refer to FIG. 5. FIG. 5 is a diagram of an antenna 50 capable of adjusting impedance matching according to another embodiment of the present invention. The framework of the antenna 50 is similar to the antenna 30 in FIG. 3, only that a radiation element 54 of the antenna 50 further includes a second passive element 56 than does the radiation element 34. The second passive element 56 can be implemented by an inductor, a capacitor, or a resistor and can be installed anywhere in the radiation element 54. In addition, the antenna 50 further includes a parasitic element 52 and a second antenna 58. The parasitic element 52 is formed between the substrate 32 and the radiation element 54 for broadening bandwidths or resonating some special bandwidths. The second antenna 58 is installed on the first side 322 of the substrate 32 and can be a Wi-Fi antenna, a Wi-Max antenna, a UWB antenna, a GPS antenna, a DVB-H antenna, or antennas of other types. Please note that the above-mentioned parasitic element 52, the second antenna 58, and the second passive element 56 are merely used for illustrating exemplifications and are not necessary restrictions on the present invention. The parasitic element 52, the second antenna 58, and the second passive element 56 are optional elements.

Figure 6:
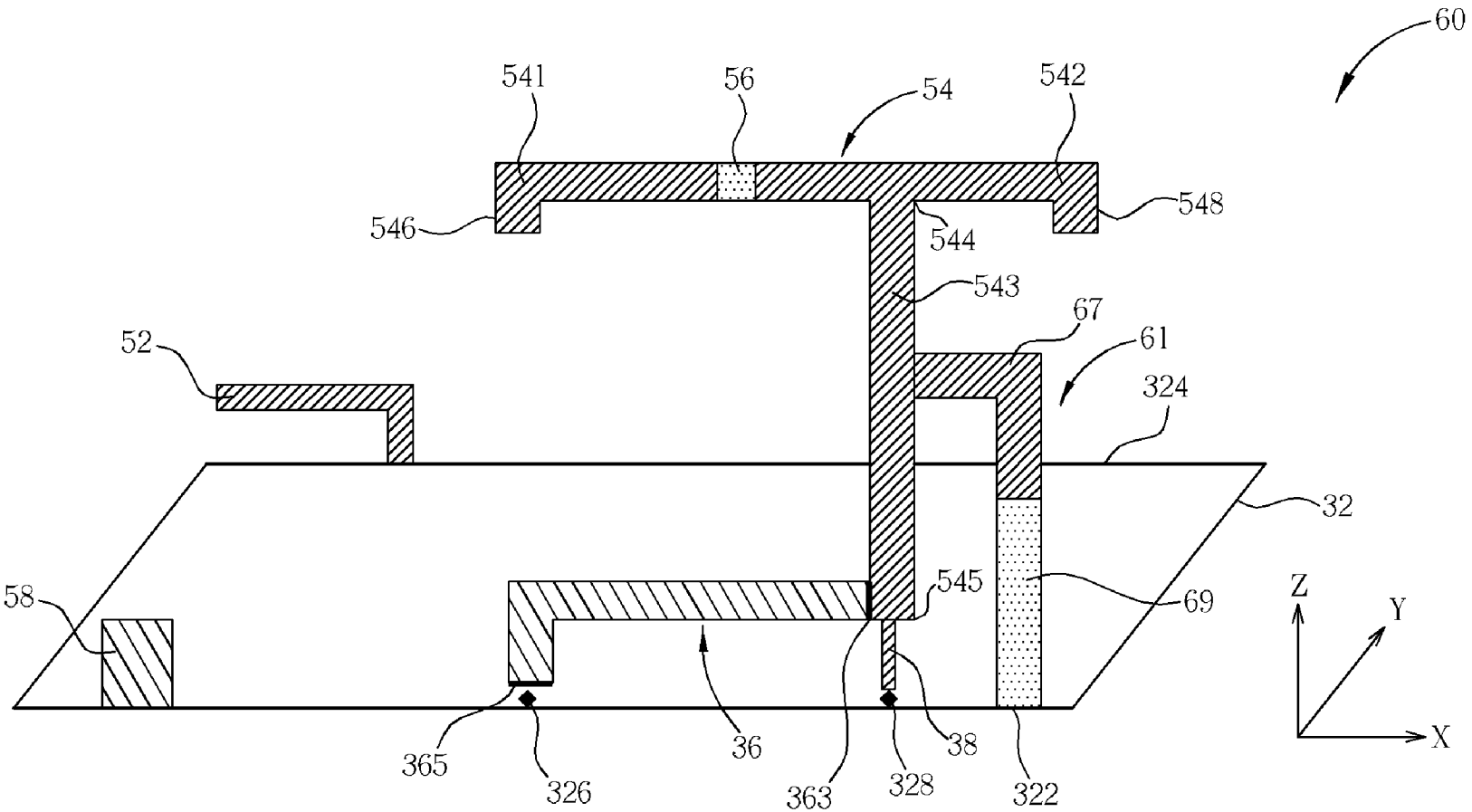
FIG. 6 is a diagram of an antenna capable of adjusting impedance matching according to another embodiment of the present invention.

Please refer to FIG. 6 that is a diagram of an antenna 60 capable of adjusting impedance matching according to another embodiment of the present invention. The difference between the antenna 60 and the antenna 50 is that a matching circuit 61 included in the antenna 60 is installed between the radiation element 54 and the first side 322 of the substrate 32, whereof the matching circuit 61 includes a second metal arm 67 and a matching element 69. The second metal arm 67 is extended from the first metal arm 543. The matching element 69 is coupled to the second metal arm 67 for providing impedance. Deserving to be noted, the matching element 69 is coupled between the second metal arm 67 and the first side 322 of the substrate 32.

Figure 7:
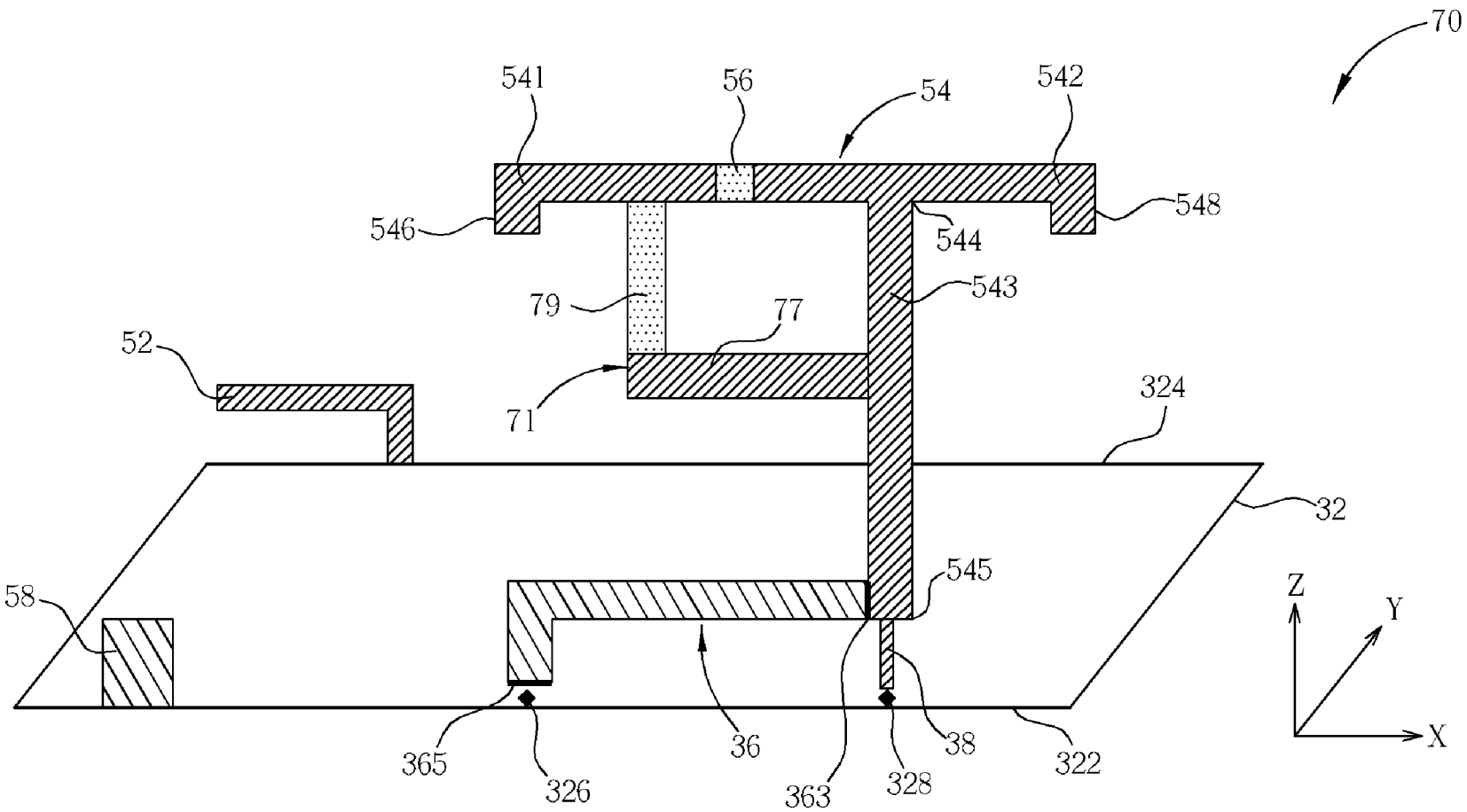
FIG. 7 is a diagram of an antenna capable of adjusting impedance matching according to another embodiment of the present invention.

Please refer to FIG. 7. FIG. 7 is a diagram of an antenna 70 capable of adjusting impedance matching according to another embodiment of the present invention. The difference between the antenna 70 and the antenna 50 is that a matching circuit 71 included in the antenna 70 is installed between the radiation element 54 and the first side 322 of the substrate 32, whereof the matching circuit 71 includes a second metal arm 77 and a matching element 79. The second metal arm 77 is extended from the first metal arm 543. The matching element 79 is coupled to the second metal arm 77 for providing impedance. Deserving to be noted, the matching element 79 is coupled between the second metal arm 77 and the second radiator 542.

Figure 8:
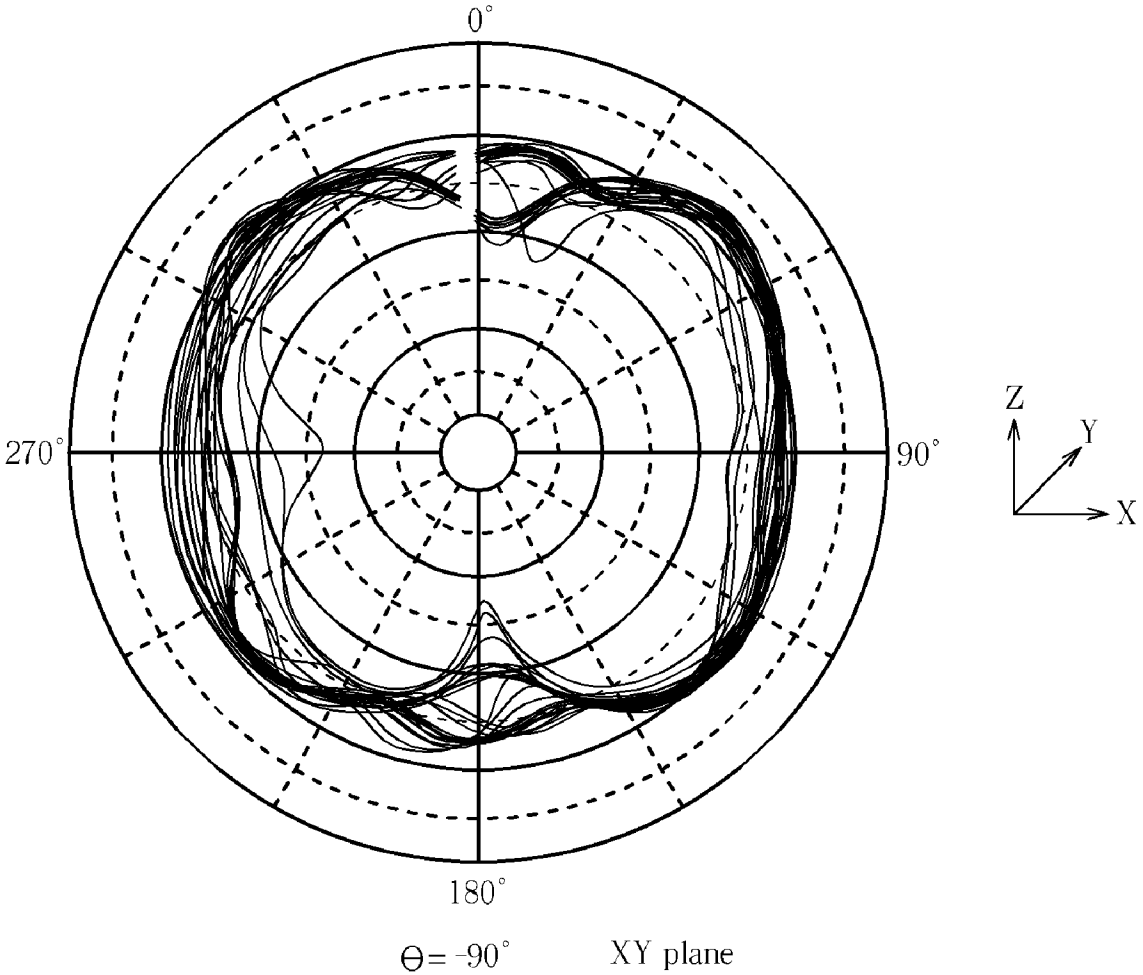
FIG. 8 is a diagram of a radiation pattern of the antenna in FIG. 3.
Figure 9:
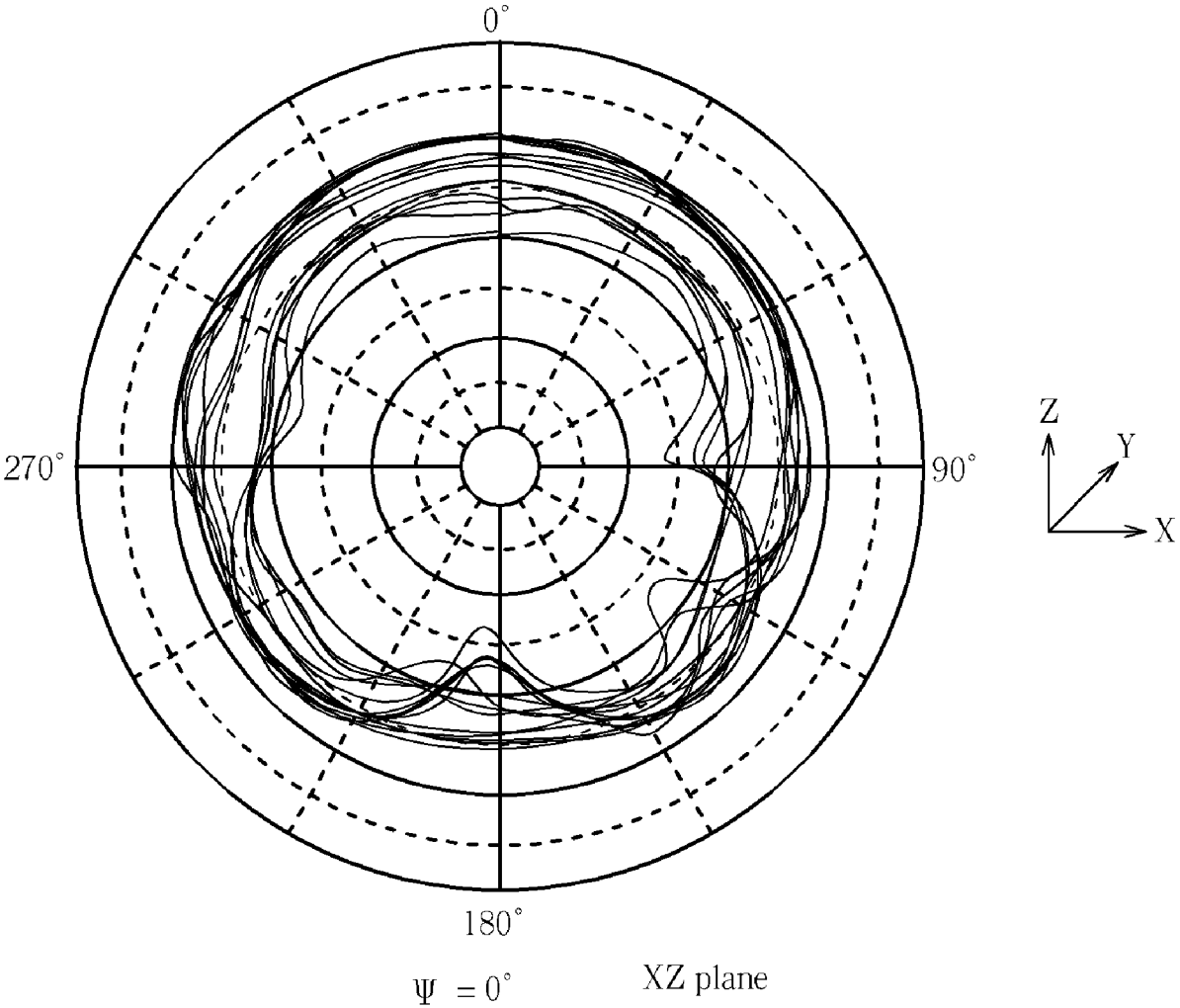
FIG. 9 is a diagram of another radiation pattern of the antenna in FIG. 3.
Figure 10:
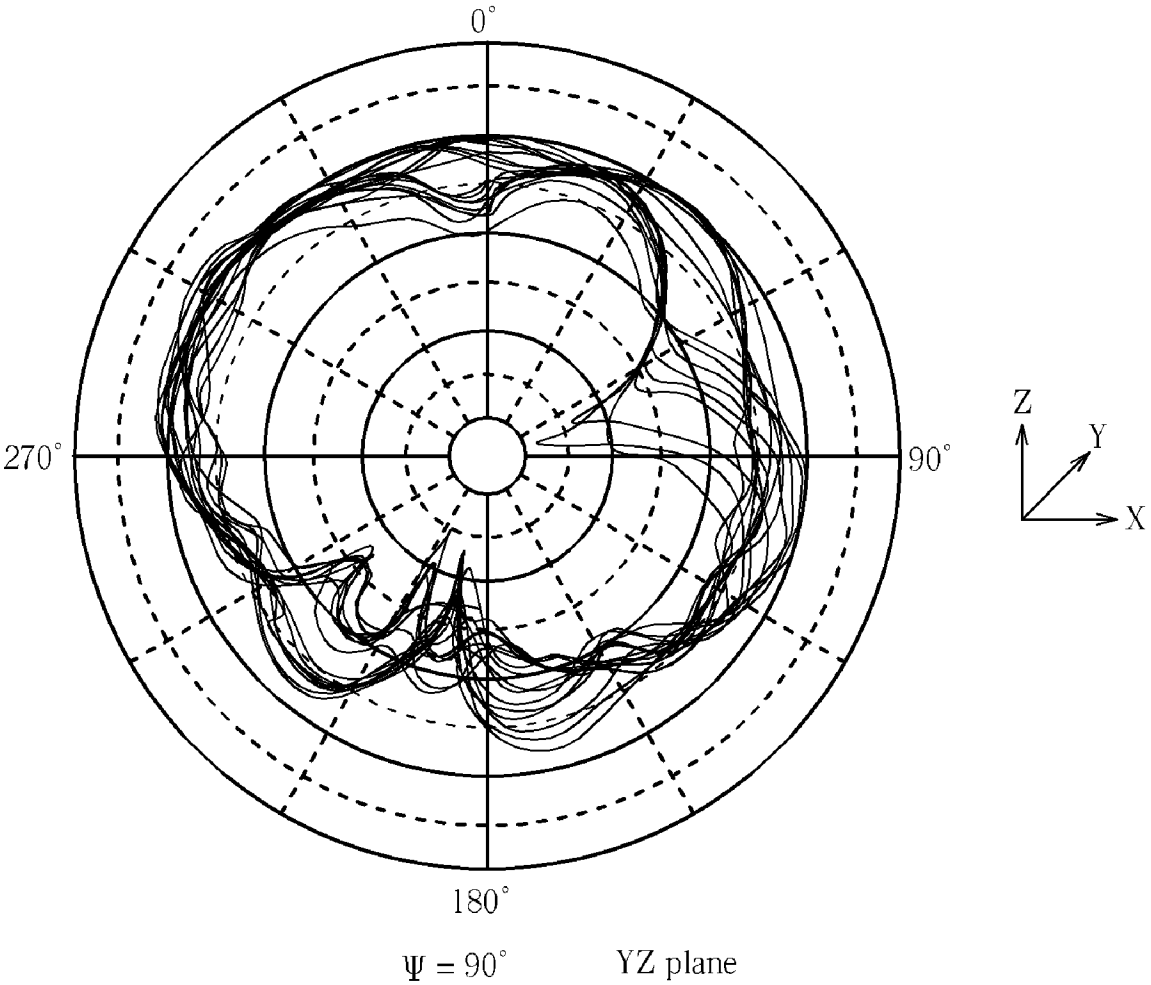
FIG. 10 is a diagram of another radiation pattern of the antenna in FIG. 3.

Please refer to FIG. 8, FIG. 9, and FIG. 10. FIG. 8, FIG. 9, and FIG. 10 are each a diagram of a radiation pattern of the antenna 30 in FIG. 3. Whereof FIG. 8 represents measuring results of the antenna 30 in the XY plane, FIG. 9 represents measuring results of the antenna 30 in the XZ plane, and FIG. 10 represents measuring results of the antenna 30 in the YZ plane. It can be seen from the measuring results, polarized radiations of the antenna 30 show a vertical polarization characteristic, and generate an approximate omni-directional radiation pattern in the XY plane to satisfy with operation demands of wireless LAN systems.

The abovementioned embodiments are presented merely for describing the present invention, and in no way should be considered to be limitations of the scope of the present invention. The length of the first radiator 341, the length of the second radiator 342, and the length of the first metal arm 343 are not limited to a fixed length and can be adjusted depends on user's demands. The matching element 39 and the second passive element 56 can be implemented by an inductor, a capacitor, or a resistor, and are not limited to these elements only. The second antenna 58 can be a Wi-Fi antenna, a Wi-Max antenna, a UWB antenna, a GPS antenna, a DVB-H antenna, or antennas in other types. The above-mentioned parasitic element 52, the second antenna 58, and the second passive element 56 are merely used for illustrating exemplifications and are not necessary restrictions on the present invention. That means the parasitic element 52, the second antenna 58, and the second passive element 56 are optional elements. Furthermore, the connection positions of the matching circuit 31, the matching circuit 61, and the matching circuit 71 are different from each other (the first length L1 and the second length L2 are adjustable) but are merely used for illustrating exemplifications and are not limited to disclosed embodiments of the present invention.

From the above descriptions, the present invention provides the antennas 30, 50, 60 and 70 capable of adjusting impedance matching, which can resonate impedance bandwidths of different frequencies by way of adjusting the length of the first radiator 341, the length of the second radiator 342, and the length of the first metal arm 343. Moreover, the connection positions of the matching circuit 31, the matching circuit 61, and the matching circuit 71 are different from each other, and their connection positions can be adjusted to obtain different matching impedances by adjusting the first length L1 and the second length L2. Adding the passive elements such as the matching elements 39, 69, and 79 in to antenna circuits can improve antenna efficiency and impedance matching effectively. The second antenna 58 is collocated with the antenna of the present invention to integrate WWAN and WLAN in the same antenna framework. Not only can space be saved and costs lowered, but the antennas also can be widespread applied to wireless terminal apparatuses, such as GSM, WLAN, Bluetooth, etc.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna capable of adjusting impedance matching comprising:

a substrate having a first side and a second side, the first side comprising a short point and a grounding point;

a radiation element installed on the first side, the radiation element comprising:

a first radiator approximately paralleling the first side;

a second radiator approximately paralleling the first side and extended in a direction opposite to the first radiator; and a first metal arm approximately perpendicular to the first side and having a first end coupled to a joint of the first radiator and the second radiator, and a second end;

a feeding element coupled between the second end of the first metal arm and the grounding point;

a connection element having a first end coupled to the second end of the first metal arm, and a second end coupled to the short point; and a matching circuit installed between the radiation element and the first side of the substrate, the matching circuit comprising:

a second metal arm extended from the first metal arm; and a matching element coupled to the second metal arm for providing impedance, wherein the matching element is coupled between the second metal arm and the connection element.

2. The antenna of claim 1 wherein the matching element comprises passive elements.

3. The antenna of claim 1 wherein the matching element is an inductor, a capacitor, or a resistor.

4. The antenna of claim 1 wherein the matching element is coupled between the second metal arm and the first side.

5. The antenna of claim 1 wherein the matching element is coupled between the second metal arm and the first radiator.

6. The antenna of claim 1 wherein the matching element is coupled between the second metal arm and the second radiator.

7. The antenna of claim 1 wherein the substrate comprises dielectric material.

8. The antenna of claim 1 wherein the substrate comprises magnetic material.

9. The antenna of claim 1 wherein the substrate is coupled to a system ground terminal.

10. The antenna of claim 1 wherein the radiation element and the connection element are substantially composed of a single metal sheet.

11. The antenna of claim 1 wherein a length of the first radiator is greater than a length of the second radiator.

12. The antenna of claim 1 wherein a sum of a length of the first radiator and a length of the first metal arm is approximately one-fourth of a wavelength of a first resonance mode generated by the antenna.

13. The antenna of claim 1 wherein a sum of a length of the second radiator and a length of the first metal arm is approximately one-fourth of a wavelength of a second resonance mode generated by the antenna.

14. The antenna of claim 1 wherein a rear end of the first radiator comprises a bending.

15. The antenna of claim 1 wherein a rear end of the second radiator comprises a bending.

16. The antenna of claim 1 further comprising a parasitic element formed between the substrate and the radiation element for broadening bandwidths.

17. The antenna of claim 1 wherein the antenna is installed in a wireless communication device.

18. The antenna of claim 17 wherein the wireless communication device is a notebook computer.

19. The antenna of claim 17 wherein the wireless communication device is a mobile phone or a personal digital assistant (PDA).

* * * * *